US007870626B2

(12) United States Patent
Antinori

(10) Patent No.: US 7,870,626 B2
(45) Date of Patent: Jan. 18, 2011

(54) MATTRESS HAVING A SPRING UNIT WITH A SINGLE UPPER PERIPHERAL BORDER ROD LOCKED WITHIN A CHAMBER OF A SYNTHETIC FOAM PLASTIC MATERIAL HOUSING

(75) Inventor: Steven J. Antinori, Tampa, FL (US)

(73) Assignee: Spring Air International LLC, Chelsea, MA (US)

( * ) Notice: Subject to any disclaimer, the term of this patent is extended or adjusted under 35 U.S.C. 154(b) by 1116 days.

(21) Appl. No.: 10/446,729

(22) Filed: May 29, 2003

(65) Prior Publication Data

US 2004/0237204 A1 Dec. 2, 2004

(51) Int. Cl.
*A47C 23/05* (2006.01)

(52) U.S. Cl. ..... 5/717; 5/727

(58) Field of Classification Search ..... 5/716, 5/717, 727, 739, 721

See application file for complete search history.

(56) References Cited

U.S. PATENT DOCUMENTS

| | | | | | |
|---|---|---|---|---|---|
| 2,469,084 | A | | 5/1949 | Schenker | |
| 2,826,769 | A | * | 3/1958 | Drews | 5/717 |
| 2,836,228 | A | | 5/1958 | Dahle | |
| 2,940,089 | A | * | 6/1960 | Koenigsberg | 5/717 |
| 3,210,781 | A | | 10/1965 | Pollock | |
| 3,262,135 | A | * | 7/1966 | Fasanella | 5/717 |
| 3,618,146 | A | * | 11/1971 | Ferdinand | 5/717 |
| 3,822,426 | A | * | 7/1974 | Mistarz | 5/717 |
| 3,906,560 | A | * | 9/1975 | Bulloch, Jr. | 5/721 |
| 3,923,293 | A | * | 12/1975 | Wiegand | 5/721 |
| 4,057,860 | A | * | 11/1977 | Higgins et al. | 5/721 |
| 4,067,076 | A | * | 1/1978 | Krier | 5/717 |
| 4,086,675 | A | | 5/1978 | Talbert et al. | |
| 4,116,735 | A | * | 9/1978 | Plasse | 156/79 |
| 4,120,059 | A | * | 10/1978 | Cavaler | 5/721 |
| 4,405,681 | A | | 9/1983 | McEvoy | |
| 4,476,595 | A | * | 10/1984 | Ikeda | 5/721 |
| 4,673,452 | A | | 6/1987 | Awdhan | |
| 5,065,485 | A | | 11/1991 | Zocco | |
| 5,105,488 | A | | 4/1992 | Hutchinson et al. | |
| 5,107,558 | A | | 4/1992 | Luck | |
| 5,136,740 | A | | 8/1992 | Kraft | |
| 5,636,396 | A | * | 6/1997 | Workman et al. | 5/717 |
| 5,701,623 | A | * | 12/1997 | May | 5/739 |
| 5,787,532 | A | * | 8/1998 | Langer et al. | 5/717 |
| 5,860,200 | A | * | 1/1999 | Wells et al. | 5/716 |
| 6,065,168 | A | * | 5/2000 | Damron | 5/716 |
| 6,158,071 | A | * | 12/2000 | Wells | 5/717 |
| 6,202,238 | B1 | * | 3/2001 | Mossbeck et al. | 5/717 |
| 6,243,900 | B1 | * | 6/2001 | Gladney et al. | 5/720 |
| 6,339,857 | B1 | * | 1/2002 | Clayton | 5/716 |
| 6,643,876 | B2 | * | 11/2003 | Visser et al. | 5/716 |
| 6,813,791 | B2 | * | 11/2004 | Mossbeck et al. | 5/716 |
| 6,829,798 | B2 | * | 12/2004 | Wells | 5/721 |

* cited by examiner

*Primary Examiner*—Michael Safavi
(74) *Attorney, Agent, or Firm*—Reed Smith LLP

(57) ABSTRACT

A mattress includes a chamber defined by upper and lower panels and a peripheral border all constructed from synthetic polymeric/copolymeric plastic material and housing therein a spring unit. The spring unit includes a plurality of springs having upper ends connected to a peripheral border rod. The spring unit is devoid of a peripheral border rod at lower ends of the springs. Upper edges of the spring unit can be deformably gripped by the upper panel, the peripheral border and/or both to prevent "swimming pool" effect.

16 Claims, 4 Drawing Sheets

MATTRESS HAVING A SPRING UNIT WITH A SINGLE UPPER PERIPHERAL BORDER ROD LOCKED WITHIN A CHAMBER OF A SYNTHETIC FOAM PLASTIC MATERIAL HOUSING

BACKGROUND OF THE INVENTION

Conventional mattresses are constructed in many different ways to provide uniform or varied firmness along their lengths, such as conventional coil spring mattresses or synthetic foam mattresses. Other mattresses include housings made of synthetic polymeric/copolymeric plastic material generally formed by upper and lower layers or panels and a peripheral border therebetween. In one type of mattress one or more synthetic plastic material panels are housed within the chamber of the mattress housing. In another type mattress a spring unit or a series of springs or inflatable units or conventional natural fibers are similarly housed within the chamber of such mattress housings. A further mattress includes both one or more panels of synthetic plastic material and coil springs housed within a chamber of a mattress housing.

All such mattresses are said to have a variety of different advantages, and typical of mattresses defined by a synthetic plastic material mattress housing defining a chamber in which are housed one or more layers of polymeric/copolymeric plastic material, including foam, are McEvoy, U.S. Pat. No. 4,405,681 issued on Sep. 20, 1983; Dahle, U.S. Pat. No. 2,836,228 issued on Jun. 15, 1956; Lück, U.S. Pat. No. 5,107,559 issued on Apr. 28, 1992; Talbert et al., U.S. Pat. No. 4,086,675 issued on May 2, 1978 and May, U.S. Pat. No. 5,701,623 issued on Dec. 30, 1997. Such mattresses are said to advantageously provide desired support, differential hardnesses, extremely high resistance to compression, resilience to return from a compressed condition substantially to the original uncompressed form, differential firmness, edge firmness and softer centers, etc.

Much the same advantages are claimed for mattresses in which a spring unit or individual spring coils are housed within a chamber of a synthetic plastic material mattress housing with or without synthetic plastic panels also being housed within the chamber. Typical of the latter mattresses can be found in Zocco, U.S. Pat. No. 5,065,485 issued on Nov. 19, 1991; Pollock, U.S. Pat. No. 3,210,781 issued on Oct. 12, 1965; Schenker, U.S. Pat. No. 2,469,084 issued on May 3, 1949; Kraft, U.S. Pat. No. 5,136,740 issued on Aug. 11, 1992 and Hutchinson et al., U.S. Pat. No. 5,105,488 issued on Apr. 21, 1992. Though the latter type mattresses exhibit numerous advantages, a major disadvantage is the "swimming pool" effect of the coil spring unit and the synthetic polymeric/copolymeric synthetic plastic material housing. Heretofore such spring units continuously floated or shifted within the associated chamber of the plastic mattress housing ("swimming pool" effect) which created excessive wear and increased the return rate of such mattresses which quickly deteriorated over a short period of time as the inner surfaces or walls defining the mattress housing deteriorated under continuous rubbing and grinding of the spring unit as it continuously shifted when in use. Normally such coil spring units are defined by a number of coils and upper and lower heavier peripherally extending border rods which are attached to the coils by clips. When such coil spring units are loosely dropped into and are housed loosely within the chamber of an associated plastic mattress the clips and the upper and lower border rods rub and grind away at the inner surfaces or walls of the peripheral border and/or the upper and/or lower panels of the plastic mattress housing.

Such conventional mattresses utilizing spring units formed by both upper and lower relatively rigid peripheral border rods clipped to upper and lower coil loops of coils are also extremely rigid and are not susceptible to bending either transversely or longitudinally, as is oft times desired when mattresses are transported, removed, installed, flipped, etc. Such rigidity in conventional coil spring/foam housing mattresses also creates a transition area between the upper border rod and the spaced peripheral border of the mattress housing which creates an undesired peripheral gap and/or lump between the two which is noticeable when a person sits upon an edge of the mattress.

SUMMARY OF THE INVENTION

The invention herein provides a mattress formed of synthetic polymeric/copolymeric plastic material, preferably foam plastic, which forms a mattress housing defined by a lower foam panel, an upper foam panel and a peripheral foam border formed of one, two or more pieces of material collectively defining a spring unit chamber. A spring unit of the mattress of this invention includes a plurality of coil springs having upper and lower loops to the upper loops of which is connected by clips a peripheral border rod. The coil spring unit includes only one peripheral border rod and the latter is located only at the upper side of the coil spring unit. The overall length and width of the border rod is exactly equal to, slightly larger than or somewhat larger than the corresponding dimensions of the inner walls or surfaces of the peripheral border of the housing. Accordingly, with the bottom panel adhesively bonded to the peripheral border, the coil spring unit is dropped-in a chamber of the mattress housing from above with the lower coil loop of each coil spring resting upon an innermost surface of the lower panel. The border rod must be forced down into the chamber and if the peripheral dimensions thereof correspond substantially identically to the peripheral dimensions of the housing border, the upper border rod and its clips are in frictional locking relatively immobilized relationship to the inner wall or surface of the peripheral border of the housing. However, the dimensions of the inner walls or surfaces of the border are preferably foreshortened ¼-½ inch relative to the same dimensions of the upper border rod which during assembly causes the synthetic foam plastic material along an innermost upper edge of the border to compress and essentially lockingly grip the peripheral border rod along the upper edge of the plastic material border when the coil spring unit is fully seated within the mattress chamber. The latter locking avoids the "swimming pool" effect earlier described while the absence of any further peripheral border rods and particularly a lower peripheral border rod permits the mattress to be bent as earlier described.

Instead of oversizing the length and width of the upper peripheral border rod relative to the respective length and width of the mattress chamber dimensions, the height of the coil spring unit can be ¼-½ inch higher than the distance between the inner opposing surfaces of the upper and lower panels which would be the same as the height of the mattress border as defined between upper and lower surfaces thereof. After the lower panel has been adhesively bonded to the mattress border and the coil spring unit has been placed therein, the upper peripheral border rod would project the ¼-½ inch above the upper surfaces of the mattress border. However, as the upper panel is placed atop the coil spring unit and is pushed downwardly, the upper peripheral border rod and its clips embed into the inner surface of the upper panel creating a peripherally extending downwardly opening locking channel which prevents the "swimming pool" effect after the mattress has been completed by adhesively uniting the upper panel to the upper surface of the mattress peripheral border.

In further keeping with the present invention, the overall peripheral size and height of the coil spring unit can be ¼-½ inch greater than the corresponding dimensions of the chamber of the mattress housing. When finally assembled, the upper peripheral border rod will lock both with the upper interior surface of the housing border and the inner surface of the upper panel in respectively peripherally extending inwardly opening and downwardly opening locking grooves or channels.

DETAILED DESCRIPTION

Figure 1:
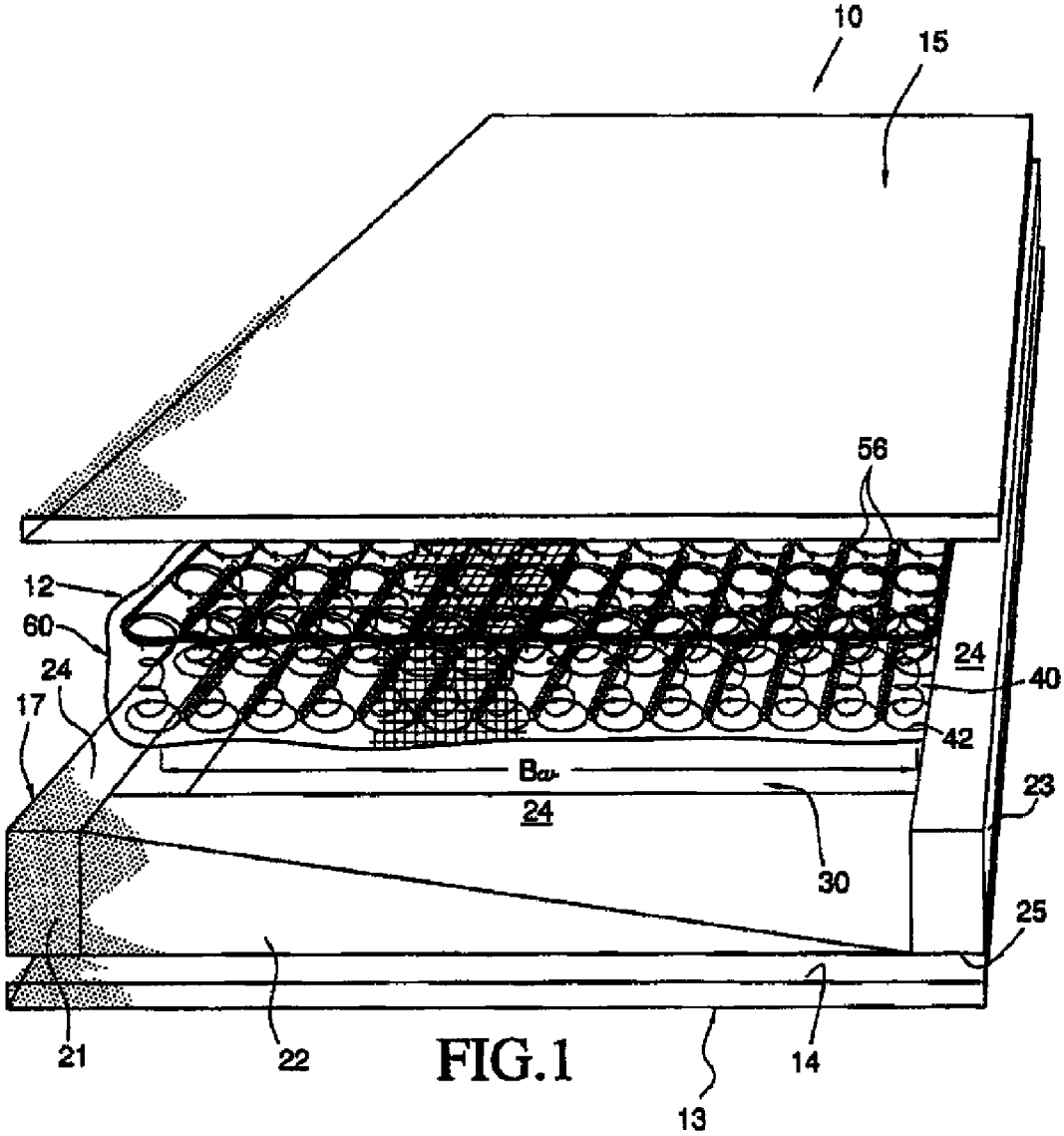
FIG. 1 is an exploded perspective view of a novel mattress constructed in accordance with this invention, and illustrates upper and lower panels and a polygonal border constructed from synthetic plastic material defining a chamber in which is housed a spring unit including only a single upper peripheral border rod united by clips to upper loops of a plurality of coil springs.
Figure 2:
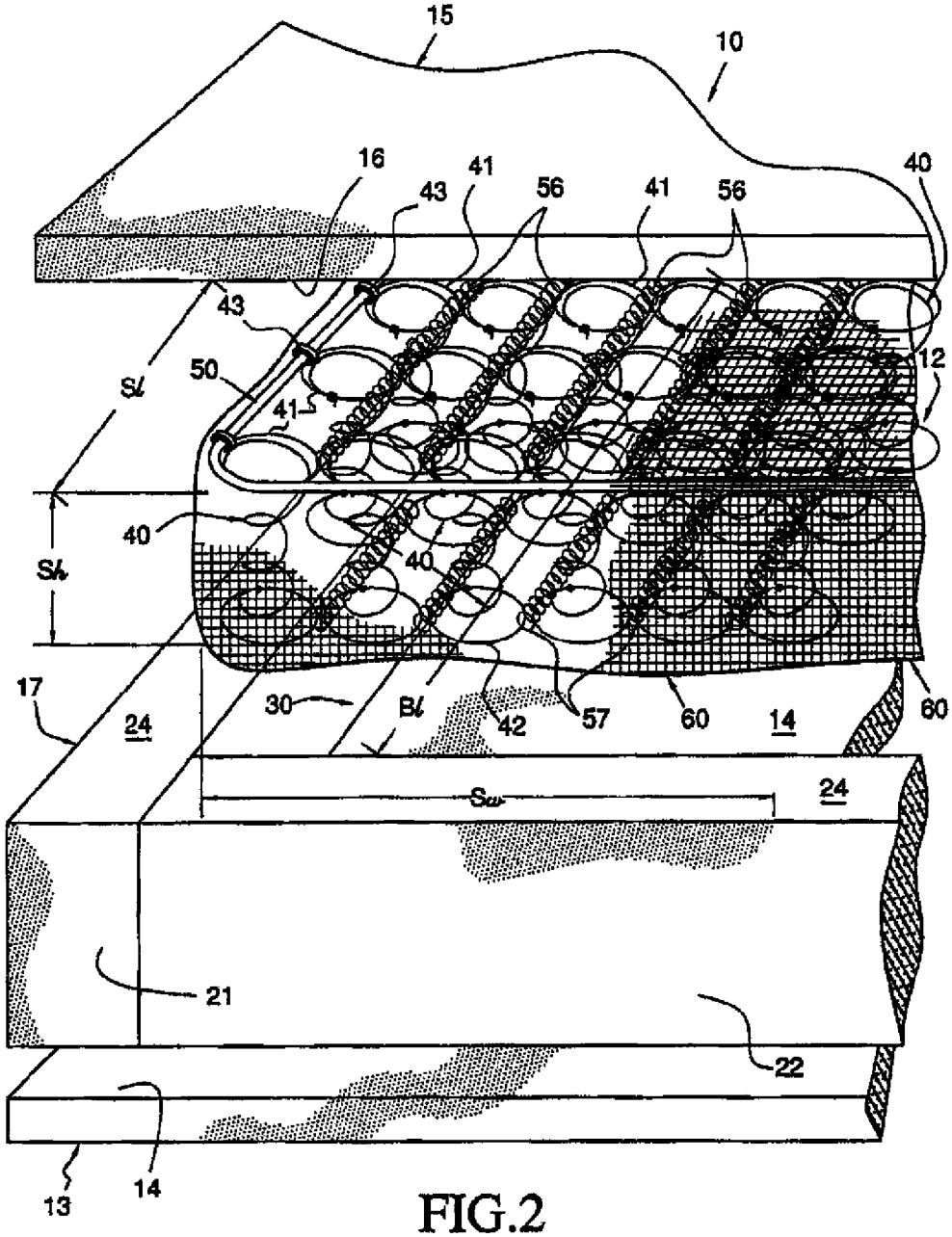
FIG. 2 is a fragmentary exploded perspective view of the mattress of FIG. 1, and illustrates details of the coil spring unit including upper and lower bonnell lacings uniting upper and lower loops of coil springs from head end to foot end of the mattress to prevent roll together.
Figure 3:
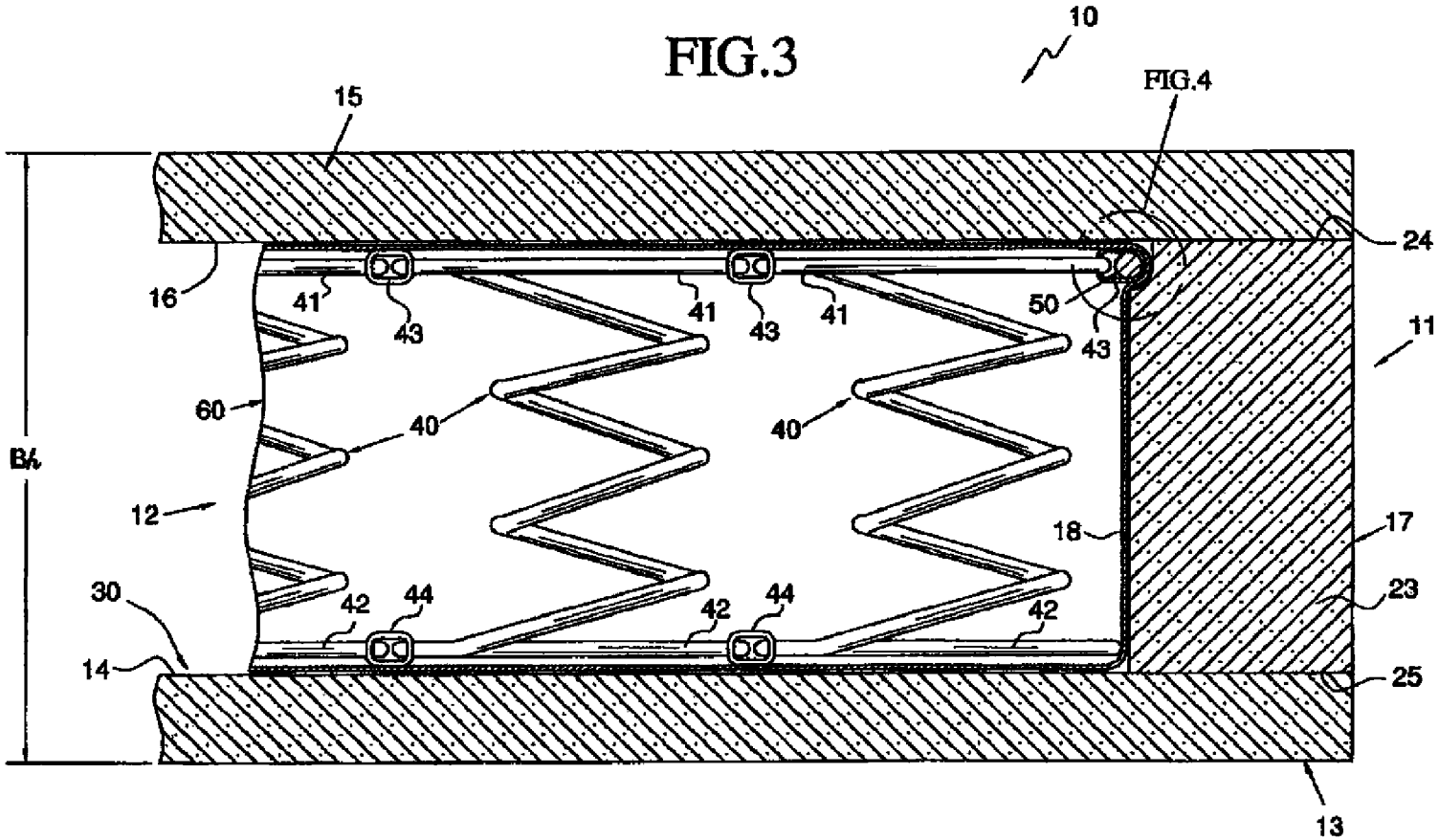
FIG. 3 is a fragmentary vertical cross-sectional view taken through the assembled mattress and illustrates the upper and lower panels adhesively bonded to the housing border and the upper peripheral border rod locked in an inwardly opening peripheral extending groove of the housing border formed during the force-fit assembly of the coil spring unit into the mattress housing chamber.

A novel mattress constructed in accordance with this invention is illustrated in FIGS. 1 through 3 of the drawings and is generally designated by the reference numeral 10.

The mattress 10 is defined by a synthetic foam plastic mattress housing 11 and a coil spring unit 12 (FIG. 3).

The mattress housing 11 is defined by a substantially rectangular or polygonal lower or bottom panel 13 having an innermost surface or wall 14, and an upper substantially polygonal or rectangular panel 15 having an innermost surface or wall 16 and a border 17 having an inner peripheral surface or wall 18. The border 17 can be a single molded component or can be a single piece of material bent at three corners and glued at a fourth corner or can be made of a plurality of individual border members, such as three of four border members illustrated in FIG. 1 and individually identified by reference numerals 21, 22 and 23. The border 17 includes an upper surface 24 and a lower surface 25 which defines a border height Bh. The inner peripheral surface or wall 18 of the border 17 also defines an inner border width Bw and an inner border length Bl (FIGS. 1 and 2). The dimensions Bh, Bw and Bl define the overall dimensions of a chamber 30 in which is housed the coil spring unit 12.

The coil spring unit 12 includes a plurality of identical bonnell coils or coil springs each being designated by the reference numeral 40 and each having respective upper and lower opposite loop portions 41, 42 positioned respectively adjacent the inner surfaces 16, 14 of the respective upper and lower panels 15, 13 in the completely assembled mattress 10, as is shown in FIG. 3. A selected plurality or all of the upper loop portions 41 are connected to each other by conventional metallic clips 43 as are the lower loop portions 42 by similar conventional metallic clips 44. A relatively rigid metallic peripheral border rod 50 is located in exterior surrounding relationship to the upper loop portions 41 of the peripherally outermost coil springs 40. The metallic clips 43 connect the peripheral border rod 50 to the upper loop portions 41 of the coil springs 40 extending along the long sides of the border 17 but need not necessarily be united to the uppermost loops in the row adjacent each of the short sides or width of the border 17, as is readily apparent from FIG. 2 of the drawings. However, the clips 43 can also be used to connect the peripheral border rod 50 to the upper loop portions 41 of the coil springs 40 in the row of coil springs most adjacent the short sides (head and foot ends) of the mattress. However, head end to foot end bonnell lacings are "laced" longitudinally to connect the upper loop portions 41 and the lower loop portions 42 of all longitudinally extending rows of coil springs 40 with the upper and lower lacings being respectively identified by reference characters 56 and 57 in FIG. 2 of the drawings. The springs 40 are also preferably spaced closer together toward the middle of the mattress 10 than at the head and foot ends to provide better support where a supine body needs it most. A plastic netting or mesh 60 encases all of the coil springs 40 and the peripheral border rod 50.

The coil spring unit 12 has a height Sh (FIG. 2), a length Sl and a width Sw. The dimensions Sh, Sl and Sw of the coil spring unit 12 correspond to the respective dimensions Bh, Bl and Bw of the chamber 30. In accordance with this invention, one or more relative dimensions Sh, Sl and/or Sw define at a minimum a frictional fit relationship, more preferably a force-fit relationship, and still more preferably an oversize fit of between ¼-½ inch relative to the corresponding dimensions Bh, Bl and/or Bw. In this manner at least one dimension, length, width or height of the coil spring unit 12 is greater than at least one dimension, length, width or height of the chamber 30 which assures that the coil spring unit 12 is virtually immovably interlocked within the chamber 30. More specifically, in keeping with the mattress 10 thus far described, both the spring unit length SI and the spring unit width Sw which are measurements of the respective length and width of the peripheral border rod 50 are ¼-½ inch greater in size than the respective dimensions BI and Bw defining the interior length and width of the chamber 30 of the mattress housing 10. Therefore, as the spring unit 12 is lowered into the chamber 30, after the surfaces 14, 25 of the respective lower panel 13 and border 17 have been adhesively bonded to each other, the peripheral border rod 50 and the clips thereof contact the upper surface 24 of the border 17 because of the oversized peripheral dimension of the upper border rod 50 as compared to the peripheral dimension of the inner surface 18 of the border 17. As the spring unit 12 is forced downwardly into the chamber 30 the upper edge of the inner peripheral surface 18 becomes distorted and, in a preferred embodiment of the invention in which the border 17 is constructed from foam material, the foam is crushed to form interlocking means 70 (FIG. 4) in the form of an inwardly opening peripherally extending channel 70 which immobilizes the coil spring unit 12 within the chamber 30. The lower interior surface 16 of the upper panel 15 is then bonded to the upper peripheral surface 24 of the border 17. As is most evident from FIG. 3, the lower loop portions 42 are unconstrained relative to the inner peripheral surface 18 of the border 17 because of the absence thereat of a peripheral border rod corresponding to the upper peripheral border rod 50. Thus the interlocking means 70 assures the "swimming pool" effect is eliminated while at the same time providing a mattress 10 of superior characteristics which can be bent considerably about its length or width, again because of the absence of any peripheral border rods beyond the border rod 50.

Figures 4, 5, 6:
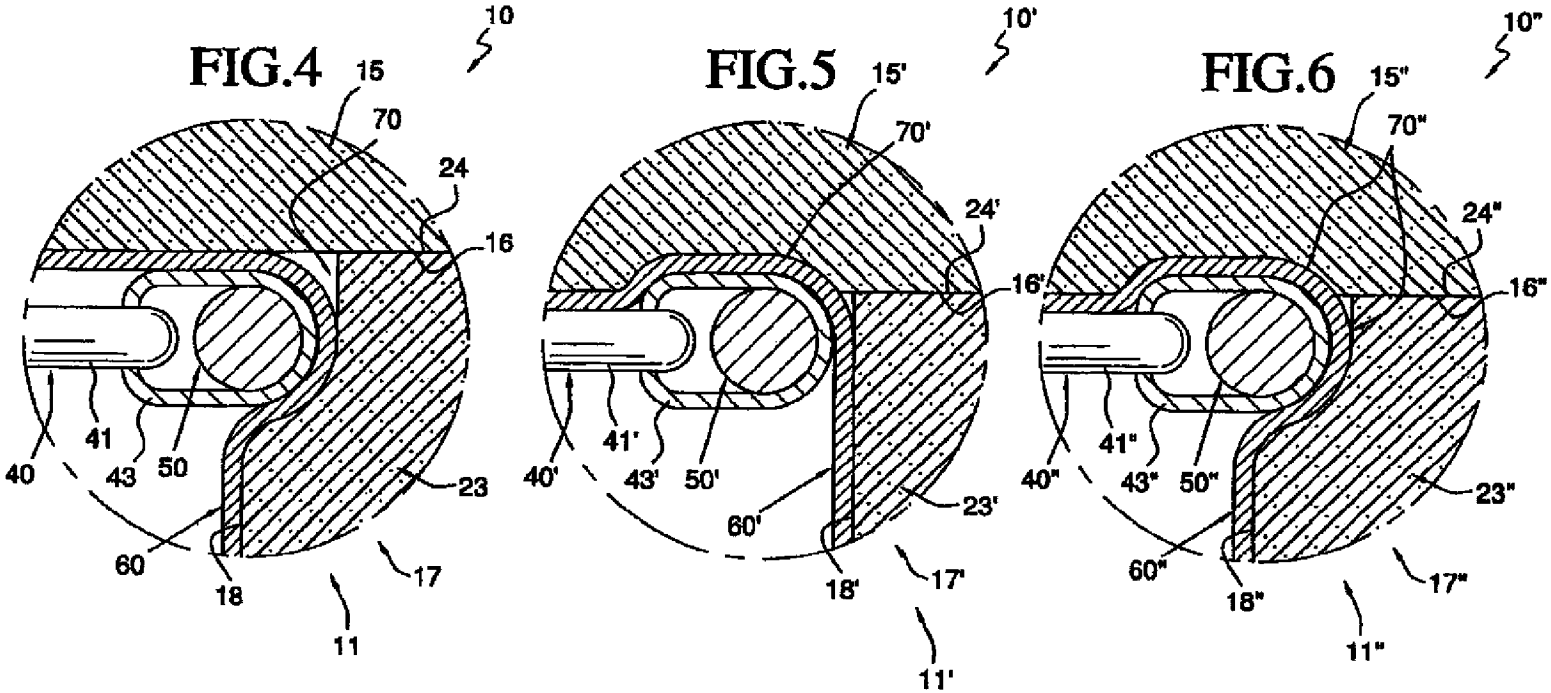
FIG. 4 is a fragmentary enlarged cross-sectional view of the encircled portion of FIG. 3, and more clearly illustrates the manner in which the upper peripherally extending border rod and one of the clips is locked in the locking channel formed by deformation of the mattress housing border during assembly.
FIG. 5 is an enlarged fragmentary view of another mattress taken in the same area as that of FIG. 4, but illustrates the manner in which the upper peripheral border rod is locked in a downwardly opening peripherally extending channel of the upper panel of the mattress housing caused by the compression of the plastic material during assembly.
FIG. 6 is an enlarged fragmentary cross-sectional view of another mattress taken through the same area as FIG. 4, and illustrates the manner in which both the peripheral border and the upper panel are deformed or distorted during assembly to form a locking channel in each for locking the upper peripheral border rod and its clips therein.

In further accordance with the present invention, a mattress 10' is illustrated in FIG. 5 which is identical in construction to the mattress 10 except the dimensions Bl, Sl and Bw, Sw are substantially the same but the height Sh of the coil spring unit 12 as measured from the top of the peripheral border rod 50 and the lowest loop portions 42 of the coil springs 40 is ¼-½ inch greater than the distance or height Bh (FIG. 3) of the chamber or compartment 30. Thus, peripheral locking means 70' is formed in the inner surface 16 of the upper panel 15 when the latter is forced downwardly upon the coil spring unit 12'. In this case the locking or interlocking means 70' is effected between only the upper panel 15' and the spring unit 12' whereas the border 17' includes its normal undeformed inner peripheral surface 18'.

A mattress 10" of FIG. 6 includes interlocking means 70" which is defined by both of the interlocking means 70, 70' of respective FIGS. 4 and 5 heretofore described. In other words, the locking or interlocking means 70" is achieved by dimensioning all three dimensions Sh, Sl and Sw of the coil spring unit 12 greater than the respective dimensions Bh, Bl and Bw of the chamber 30. The locking or interlocking means 70" is thereby effected between the coil spring unit 12" and both the inner surface 16" of the upper panel 15" and the inner peripheral surface 18" of the border 17".

What is claimed is:

1. A mattress comprising a single polygonal border defined between upper and lower terminal peripheral edge portions and upper and lower panels collectively defining a substantially closed chamber, said border and panels being constructed from synthetic plastic material, means for bonding said upper panel to said border upper terminal peripheral edge portion, means for bonding said lower panel to said border lower terminal peripheral edge portion, a spring unit housed substantially in said chamber, said spring unit including a plurality of springs each having opposite upper and lower loop portions positioned substantially adjacent the respective upper and lower panels, an upper peripheral border rod located substantially adjacent said upper panel, means for securing at least selective ones of said springs to said upper peripheral border rod along the periphery of said upper peripheral border rod, said spring unit being devoid of a lower peripheral border rod at said springs lower loop portions, means for peripherally interlocking said upper peripheral border rod substantially against movement relative to said border and upper panel, said upper peripheral border rod being substantially interlocked against lateral and longitudinal movement by an upper inner peripherally extending distorted corner of said chamber defined by said upper panel and said polygonal border in interlocking relationship with said upper peripheral border rod, and said spring unit being devoid of fabric pockets adapted to house springs.

2. The mattress as defined in claim 1 wherein the spring unit includes a body zone located between opposite head and feet zones, and the springs in the body zone are located closer together than the springs in either of the head and feet zones.

3. The mattress as defined in claim 1 wherein the spring unit includes a body zone located between opposite head and feet zones, and the springs in the body zone are located closer together than the springs in either of the head and feet zones, and all said springs are of substantially the same gauge material.

4. The mattress as defined in claim 1 wherein said polygonal border is made of at least two rails bonded to each other.

5. The mattress as defined in claim 1 wherein said polygonal border is made of at least two rails bonded to each other and to said upper and lower panels.

6. The mattress as defined in claim 1 wherein said polygonal border is made of at least four rails bonded to each other.

7. The mattress as defined in claim 1 wherein said polygonal border is made of at least four rails bonded to each other and to said upper and lower panels.

8. The mattress as defined in claim 1 wherein said spring unit is further defined by opposite head and foot ends and opposite sides, said springs are disposed in substantially parallel head to foot end side-by-side rows, and a helical lacing uniting together the springs upper loop portions of immediately adjacent rows between said opposite head and foot ends.

9. The mattress as defined in claim 1 wherein said synthetic plastic material of said border and panels is foam.

10. The mattress as defined in claim 1 wherein said synthetic plastic material of said border and panels is polyurethane foam.

11. The mattress as defined in claim 1 wherein said peripherally interlocking means includes said upper peripheral border rod being in intimate bearing engagement with an opposing inner upper peripheral surface of said border whereby an upper side of the spring unit is substantially confined against lateral movement to prevent a swimming pool effect.

12. The mattress as defined in claim 1 wherein said peripherally confining means includes said peripheral border rod being in intimate bearing engagement with an opposing inner upper peripheral surface of said border and an immediately adjacent lower peripheral surface of said upper panel whereby an upper side of the spring unit is substantially confined against lateral movement to prevent a swimming pool effect.

13. The mattress as defined in claim 1 wherein said peripherally interlocking means includes said upper peripheral border rod being in intimate bearing engagement with an opposing inner upper peripheral surface of said border whereby an upper side of the spring unit is substantially confined against lateral movement to prevent a swimming pool effect, and said border opposing inner upper peripheral surface is deformed by and interlocked with said peripheral border rod.

14. The mattress as defined in claim 1 wherein said peripherally interlocking means includes said upper peripheral border rod being in intimate bearing engagement with an immediately adjacent lower peripheral surface of said upper panel whereby an upper side of the spring unit is substantially confined against lateral movement to prevent a swimming pool effect.

15. The mattress as defined in claim 14 wherein said immediately adjacent lower peripheral surface of said upper panel is deformed by and interlocked with said upper peripheral border rod.

16. The mattress as defined in claim 12 wherein the opposing inner upper peripheral surface of said border and the immediately adjacent lower peripheral surface of said upper panel are each deformed by and interlocked with said upper peripheral border rod.

* * * * *